US006297486B1

(12) United States Patent
Rom et al.

(10) Patent No.: US 6,297,486 B1
(45) **Date of Patent: *Oct. 2, 2001**

(54) BASE DRAG REDUCING DEVICE

(75) Inventors: Hanan Rom, Misgav; Zvi Weinberg, Haifa, both of (IL)

(73) Assignee: Rafael Armament Development Authority Ltd., Haifa (IL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/946,978

(22) Filed: Oct. 8, 1997

(30) Foreign Application Priority Data

Oct. 9, 1996 (IL) ..... 119392

(51) Int. Cl.[7] ..... F42B 10/34

(52) U.S. Cl. ..... 244/3.3; 244/3.1; 244/130; 102/385; 102/490

(58) Field of Search ..... 244/12.2, 34 A, 244/3.26, 3.27, 3.28, 3.3, 3.24, 130, 199, 3.1, 3.21; 102/503, 490, 388, 293, 384, 385, 372, 373; 296/180.1; 105/1.3; 180/903

(56) References Cited

U.S. PATENT DOCUMENTS

| | | | | |
|---|---|---|---|---|
| H854 | * | 12/1990 | Maddera | 244/3.28 |
| 2,393,604 | * | 1/1946 | Berger | 244/3.3 |
| 2,694,364 | * | 11/1954 | Liljegren | 244/33 |
| 2,892,409 | * | 6/1959 | Lyon | 244/3.24 |
| 3,188,957 | * | 6/1965 | Petre | 244/3.27 |
| 3,724,782 | * | 4/1973 | Gauzza et al. | 244/3.27 |
| 3,993,269 | * | 11/1976 | Crosby, Jr. | 244/33 |
| 4,153,223 | * | 5/1979 | Romer et al. | 244/3.1 |
| 4,158,447 | * | 6/1979 | Humphries et al. | 244/3.27 |
| 4,554,872 | | 11/1985 | Schleicher | 102/490 |
| 4,558,898 | | 12/1985 | Deaver . | |
| 4,674,706 | * | 6/1987 | Hall | 244/3.3 |
| 4,688,840 | | 8/1987 | Kretschmer . | |
| 4,807,535 | | 2/1989 | Schilling et al. | 490/102 |
| 5,078,337 | * | 1/1992 | Waller | 244/3.28 |
| 5,295,643 | * | 3/1994 | Ebbert et al. | 244/12.2 |
| 5,348,366 | | 9/1994 | Baker et al. | 296/180.4 |
| 5,374,013 | * | 12/1994 | Bassett et al. | 244/130 |
| 5,816,531 | * | 10/1998 | Hollis et al. | 244/3.27 |

FOREIGN PATENT DOCUMENTS

| | | | | |
|---|---|---|---|---|
| 2161588 | * | 1/1986 | (GB) | 244/33 |

OTHER PUBLICATIONS

"Effectiveness of Passive Devices for Axisymmetric Base Drag Reduction at Mach 2" P.R Viswanath and S.R Patil National Aeronautical Laboratory, Bangalore, India Article: J. Spacecraft vol. 27, No. 3 p. 234, Aug. 1989.

"Axisymmetric Bluff–Body Drag Reduction Through Geometrical Modification". Floyd G. Howard and Wesley L Goodman NASA Langley Research Center, Hampton, Virginia. Article–J. Aircraft vol. 22, No. 6 p. 516, Mar. 1984.

"Passive Devices for Axisymmetric Base Drag Reduction at Transonic Speeds" P.R. Viswanath National Aeronautical Laboratory, Bangalore, India Article–J. Aircraft vol. 25, No. 3 p. 258, Apr. 1987.

(List continued on next page.)

*Primary Examiner*—Harold J. Tudor
(74) *Attorney, Agent, or Firm*—Eitan, Pearl, Latzer & Cohen-Zedek

(57) ABSTRACT

A device for reducing base drag on cylindrical rear truncated objects moving in a fluid, caused by the shedding of vortices at the base of the object. The device consists of ring shaped winglets attached to the rear of the object which may be sub-divided into a plurality of hinged partial winglets. The parameters of distance of winglet from cylinder shaped object, winglet circumference, angle, profile and chord length may be varied automatically for optimum drag-reducing capability.

6 Claims, 8 Drawing Sheets

OTHER PUBLICATIONS

James A. Kidd, Dennis Wikoff, Charles J. Cottrell "Drag Reduction by Controlling Flow Separation Using Stepped Afterbodies"– Air Force Armament Laboratory, Eglin Air Force Base, Florida. Article – J. Aircraft vol. 27, No. 6 pp. 564 Engineering Notes, Nov. 1989.

Maull, D.J. "Mechanisms of Two and Three Dimensional Base Drag", Plenum Press, 1978. pp. 137–159.

Kapoor K. "Effect of Radial Fins on Base Drag of an Axisymmetric Body at Low Spreeds", J. Spacecraft vol. 19, No. 1, Jan–Feb., 1982, pp. 89–92.

Mason, W.T.; Beebe, P.S. "Truck and Bus Drag", Aerodynamic Drag Mechanisms of Bluff Bodies and Road Vehicles, Plemum Press, 1978 pp. 45–93.

Hoerner, S.F. "Fluid Dynamic Drag", 1965 pp. 3–27.

* cited by examiner

BASE DRAG REDUCING DEVICE

BACKGROUND OF THE INVENTION

A drag force acts on an object which moves in a fluid environment such as air or water. This drag force includes several specific drag forces wherein the main one is known as a pressure drag force. The pressure drag force is caused by a net pressure force acting on the object. The rear end contribution to the pressure drag is called "base drag". Flow separation at the base of the moving object creates a vortex system and reduces base pressure thus increasing drag. This problem exists for truncated objects, which have blunt bases, such as a box, a cylinder and the like.

Reference is now made to FIG. 1A which is a schematic illustration of a device for reducing drag which is known in the art (Frey, D. "*Guide Vores" Foschung Ing Wessen*, 1933 and Hoemer, S. F. "*Fluid Dynamic Drag*", 1958 p. 3–27). One of the ways known in the art for reducing the base vortex strength in two-dimensional objects such as high aspect ratio wings, is by utilizing winglets near the base of the wing or behind it. wing 10 includes four winglets 12, 14, 16 and 18, which reduce the base drag by depressing the ascilatory vortex shedding from the base.

The asymmetric, ascilatory vortex shedding which greatly increases the base drag in a 2 dimensional configuration does not exist in three dimensional bodies.

Reference is now made to FIG. 1B which is a schematic illustration of a device, known in the art (Maull, D. J. "*Mechanisms of Two and Three Dimensional Base Drag*", Plenum Press, 1978), which was tested for aerodynamic drag reduction. A three dimensional blunt object 20, which in the present example is a truck, includes two rear side flow deflectors 22 and 24 and a rear top deflector 26. This configuration has proved to be inefficient in reducing the base drag and has even shown slight increases in the drag force, as compared to the baseline configuration of a truck without such deflectors.

Another device aiming at base drag reduction on blunt-based trailers is described in U. S. Pat. No. 5,348,366 (Baker and Levitt, 1994). It is shown in FIG. 3 (of Baker). The amount of drag reduction achieved by deploying the device shown in FIG. 3 is 15%. The mechanism of drag reduction is similar to that in boattailing a blunt axi-symmetric object and thus increasing its base pressure, as was suggested by Mair (1965).

Other devices for reducing the base drag of airborne axi-symmetric bodies use air bleed through the blunt base (U.S. Pat. No. 4,807,535 by M. Schilling and M. Reuche (1989) and U.S. Pat. No. 4,554,872 by U. Schleicher (1985)). These devices require, however, modification of the internal volume to accommodate the charge used to accommodate the base bleed jet.

SUMMARY OF THE PRESENT INVENTION

It is an object of the present invention to provide a device for reducing drag in a three dimensional object.

It is a further object of the present invention to provide a novel device for reducing drag in a three dimensional cylindrical object, which can be adapted to variable velocity in real time.

In accordance with the present invention there is thus provided a ringlet shaped device for reducing drag of a cylindrical rear truncated object moving in fluid, to be placed near the rear end of the object. The device includes at least one ring shaped winglet.

According to another aspect of the present invention, a selected one of the ring shaped winglets includes a plurality of partial winglets and winglet connectors, wherein each of the winglet connectors connects a predetermined pair of the partial winglets. Each winglet connector can be adapted to move the predetermined pair of the partial winglets connected thereto either to increase or decrease the distance between the elements.

Furthermore, the device may also include a ring shaped winglet, a plurality of partial winglets connected to the ring shaped winglet by a plurality of hinges, wherein the hinges enable the partial winglets to rotate along an axis tangent to the circumference of the ring which is defined by the hinges.

According to another aspect of the invention, the device further includes a controller for controlling at least one of the ring-shaped winglets according to predetermined parameters and a processor, for determining the values of each of the parameters, according to the speed of the cylindrical rear truncated object and the properties of the fluid, the processor providing the values to the controller. The predetermined parameters are selected from the group consisting of:

distance of the winglet from the cylinder shaped object;

winglet circumference;

the angle between the ring chord and the symmetry axis;

winglet profile; and winglet chord length.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

Figure 1A:
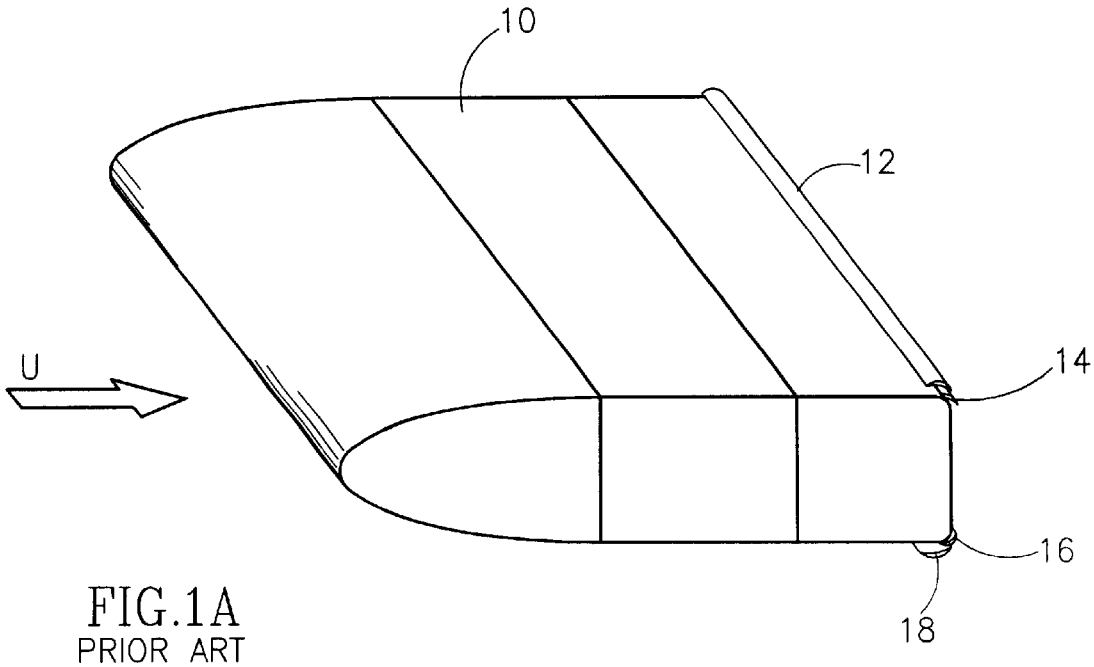
FIG.1A PRIOR ART
FIG. 1A is a schematic illustration of a prior art device for reducing drag.
Figure 1B:
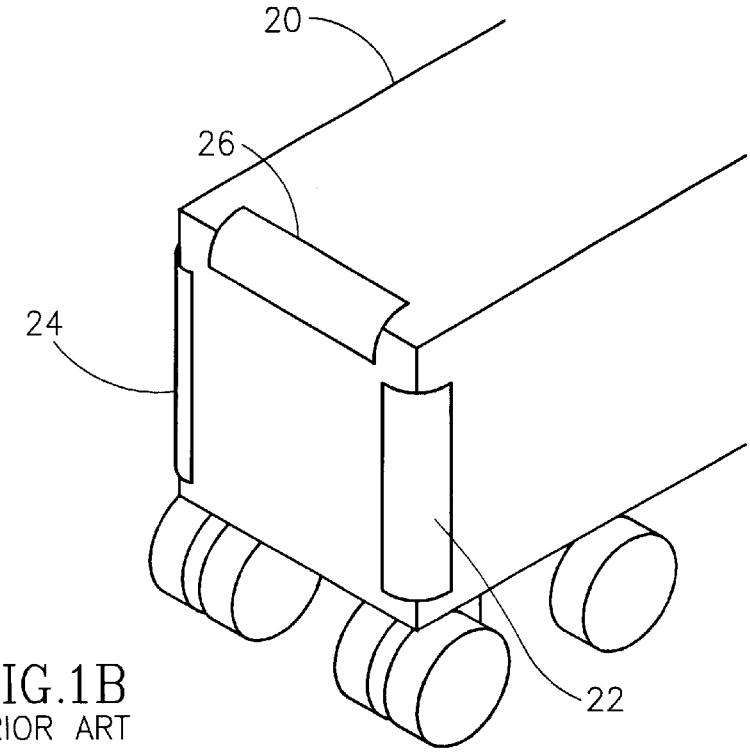
FIG.1B PRIOR ART
FIG. 1B is a schematic illustration of a prior art device which was tested for drag reduction.
Figure 2A:
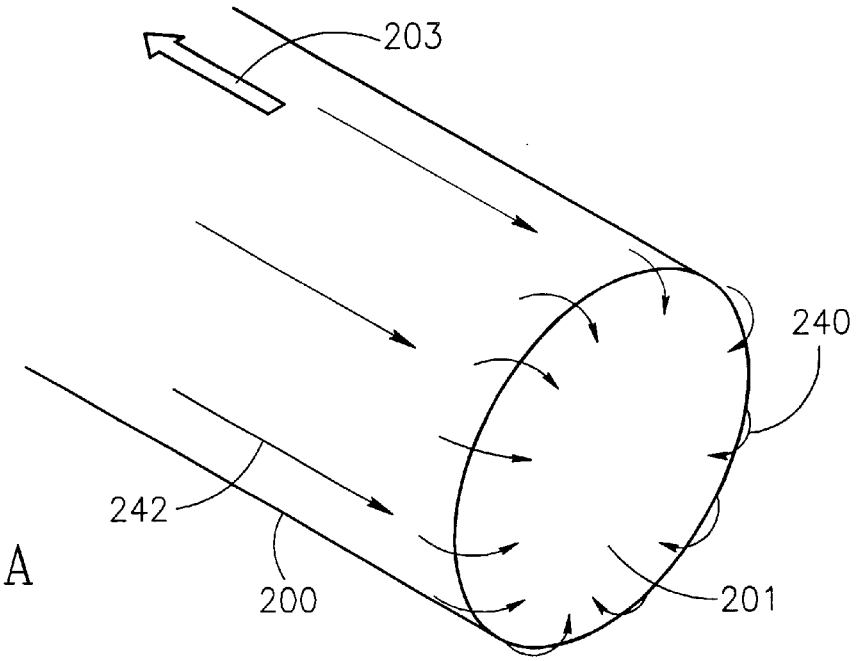
FIG. 2A is a pictorial illustration of a cylinder shaped truncated object.
Figure 2B:
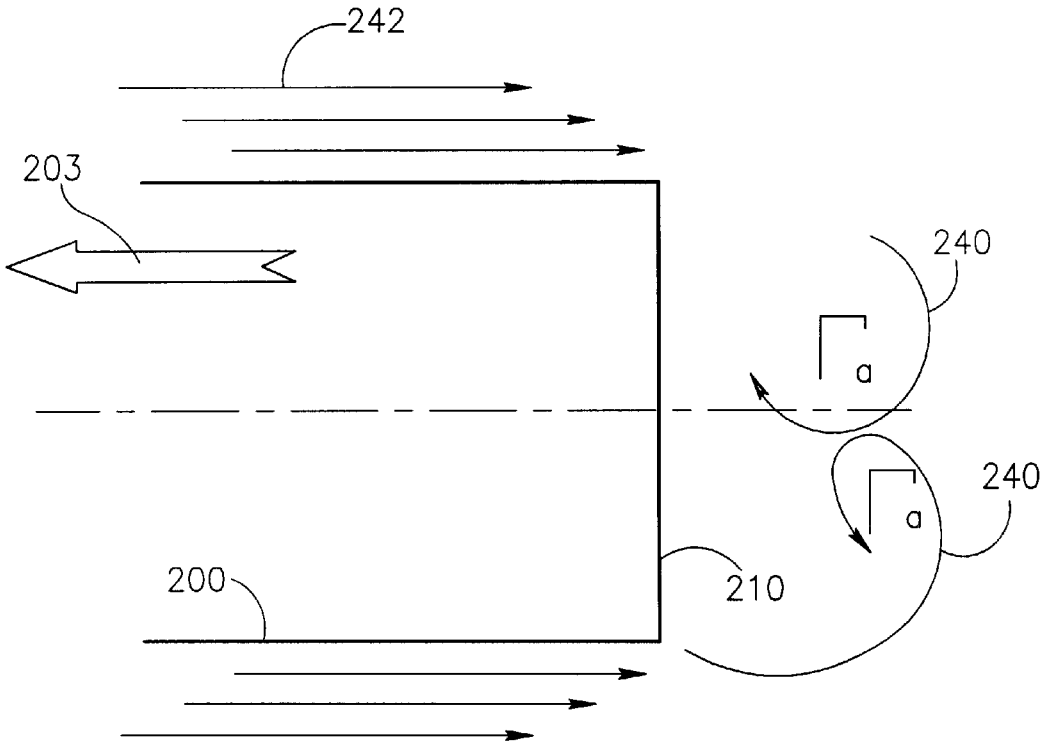
FIG. 2B is a schematic cross-sectional illustration of the vortices at the rear end of the object shown in FIG. 2A.
Figure 2C:
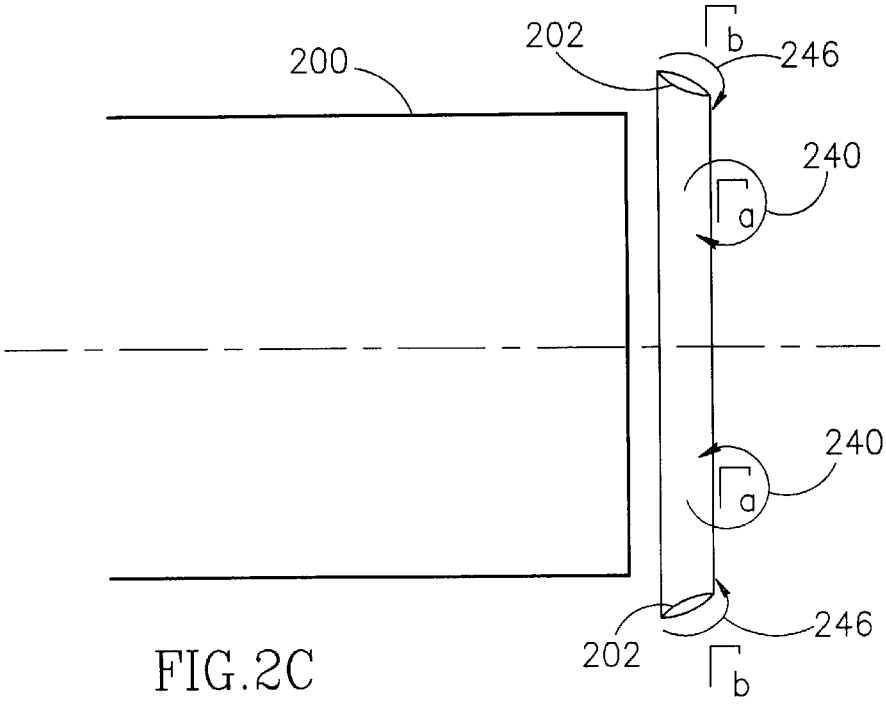
FIG. 2C is a schematic cross-sectional illustration of the vortices at the rear end of the object shown in FIGS. 2A and 2B and a device for reducing drag, constructed and operative in accordance with a preferred embodiment of the invention.
Figure 2D:
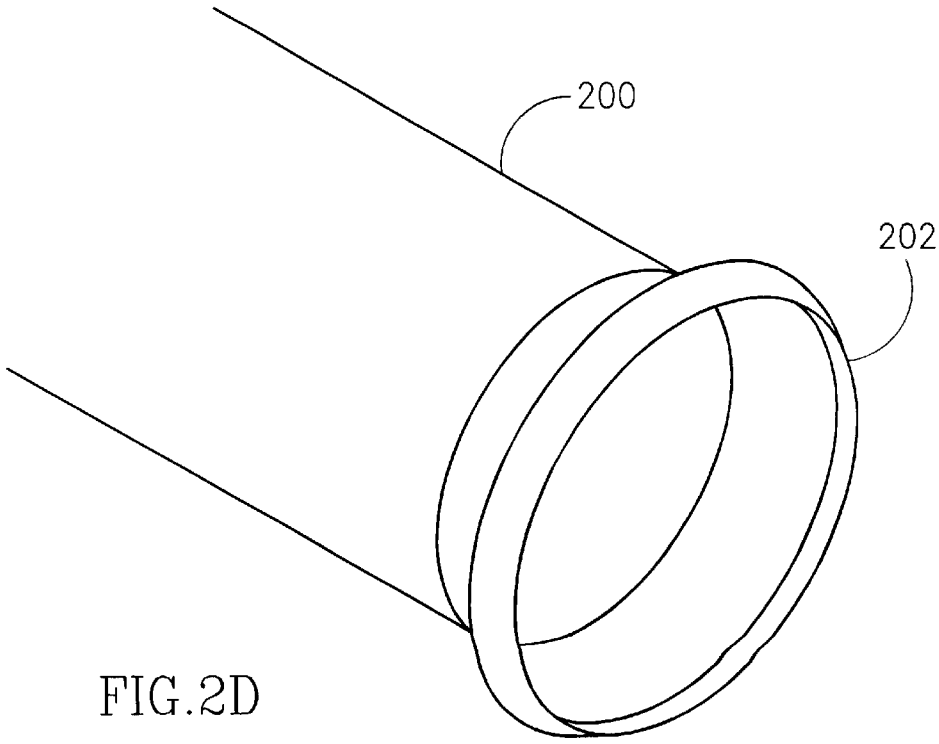
FIG. 2D is a pictorial illustration of the object and the device shown in FIG. 2C.
Figure 2E:
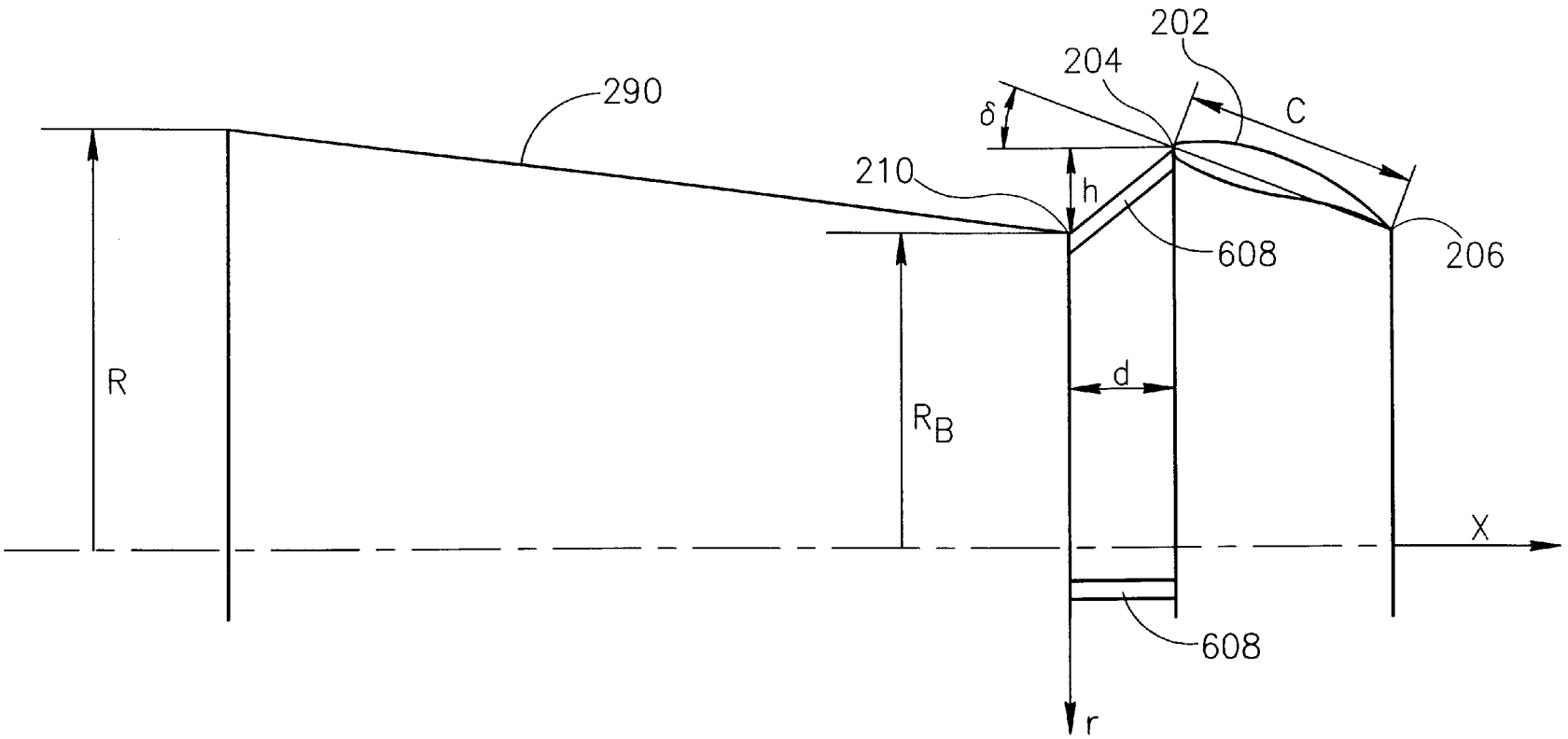
FIG. 2E is a schematic cross-section illustration of the device shown in FIG. 2C, on a boattailed cylindrical object.

Reference is now made to FIGS. 2A, 2B, 2C, 2D and 2E. FIG. 2A is a pictorial illustration of a truncated cylinder, generally referenced 200. FIG. 2B is a schematic cross-section illustration of the vortices at the rear end of object 200. FIG. 2C is a schematic cross-section illustration of the vortices at the base of object 200 with a device, generally referenced 202, constructed and operative in accordance with a preferred embodiment of the invention. FIG. 2D is a pictorial illustration of object 200 with device 202. FIG. 2E is a schematic cross-section illustration of device 202, mounted on a boattailed cylindrical object 290.

Object 200 is moving to the left in the air. Arrow 203 indicates the direction of movement of object 200. Arrow 242 indicates the movement of air alongside and relative to object 200. The object moving left forms a low pressure area behind its rear end 201. The air 242 flowing adjacent to the object 200 separates from the sharp corner at the end of the cylinder and forms a free vortex ring $\Gamma_a$, referenced 240, as illustrated in FIG. 2B. This vortex is the main cause of base drag which is a significant portion of the total drag.

According to the present invention, reduction of the base drag is provided by a circumferencial winglet 202 in the shape of a ring which is placed near the base of truncated object 200, as shown in FIGS. 2C and 2D. Winglet 202 forms a vortex ring $\Gamma_b$, referenced 246, which is located away from the center of the base of object 200. Vortex 246 causes reduction in the size and strength of the vortex 240 as can be seen by FIGS. 2B and 2C, by shifting vortex activity away from the center of the base of object 200.

A device according to the invention can be adapted to any type of generally cylinder shaped objects and, for that matter, boattailed cylinder shaped objects, which in the present example is object 290 (FIG. 2E).

Device 202, constructed in accordance with a preferred embodiment of the invention, can be adapted to various objects, fluids and velocities. There are a number of parameters (shown in FIG. 2E) which determine the efficiency of the device 202 in reducing drag, among which are:

- the distance d of the device 202 from object 290;
- the height h of the front edge 204 of device 202 from rear edge 210 of object 290;
- the chord length c between the device 202 leading edge 204 and the trailing edge 206;
- the winglet angle, which is the angle between the ring chord and the symmetry axis, δ; and
- the shape of the profile of device 202.

Applicant has realized that fine tuning these parameters using wind tunnel experiments may result in reducing base drag greatly.

Figure 3:
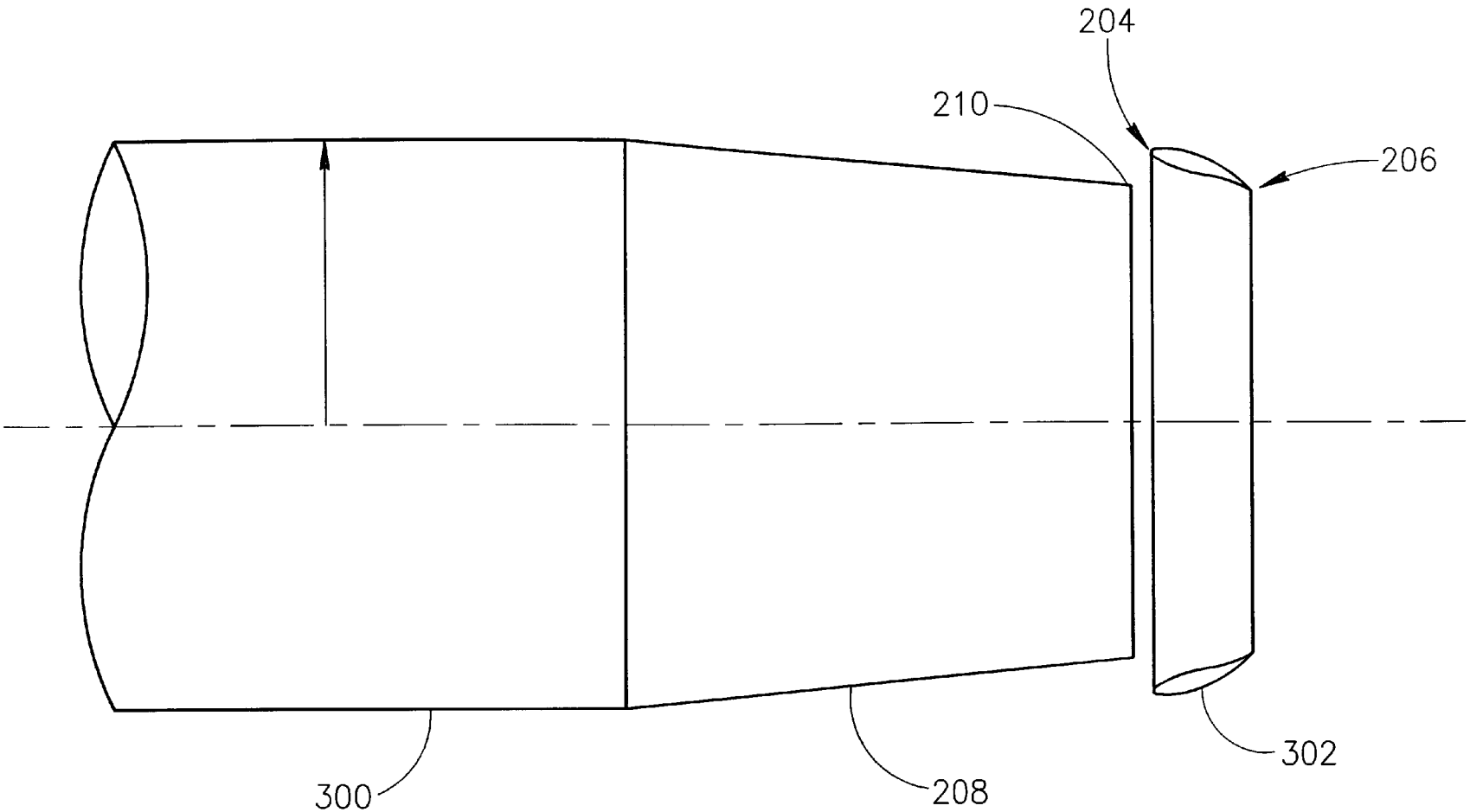
FIG. 3 is a schematic illustration of a boattailed cylindrical blunted object and a device, constructed and operative in accordance with another preferred embodiment of the present invention.

Reference is now made to FIG. 3 which is a schematic illustration of the base of a typical missile configuration 300 and a device, generally referenced 302, constructed and operative in accordance with a preferred embodiment of the present invention. Device 302 is a ringlet located near the base of configuration 300.

The device 302 according to the invention is also efficient in reducing drag, when added to a rear exhausting system, such as a missile 300. The device 302 reduces drag in a mode wherein the engine of the missile is turned on, exhausting gases backwards and also, in a mode where the engine of the missile is turned off.

Figure 4A:
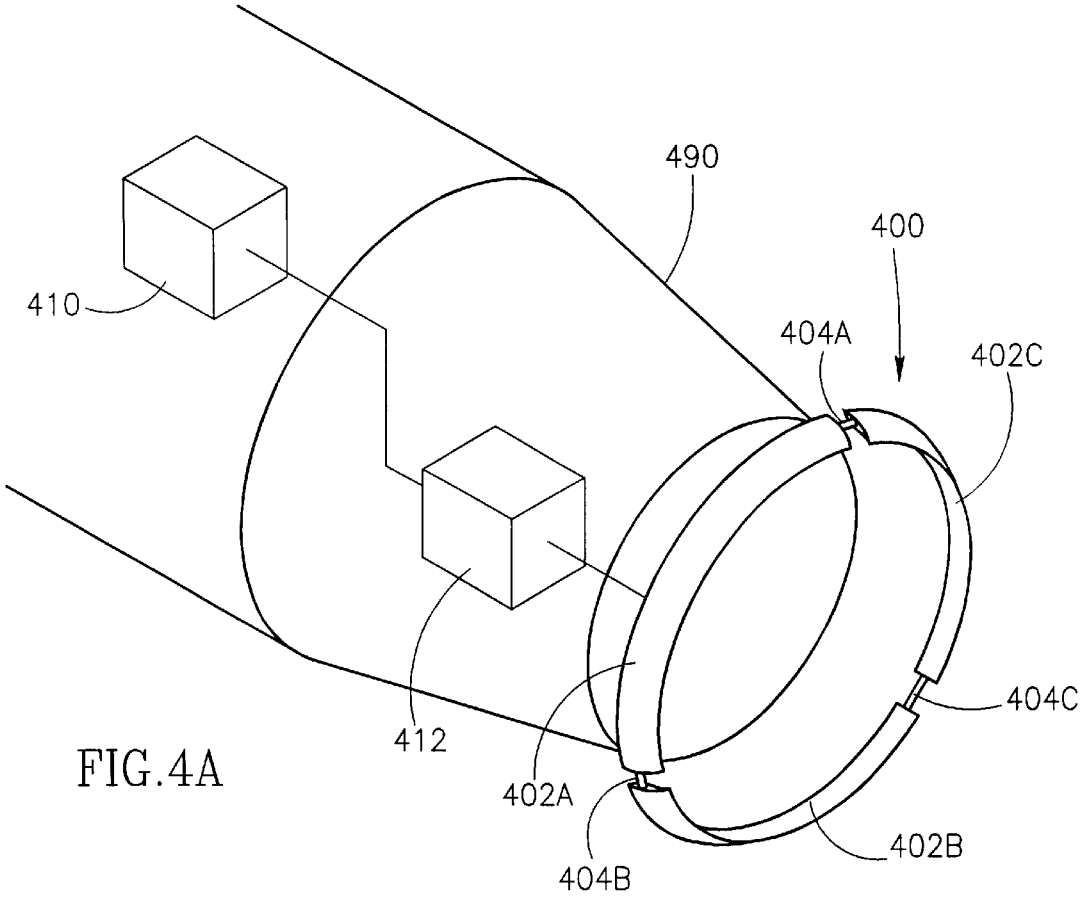
FIG. 4A is a schematic illustration of moving object and of a drag reducing device, constructed and operative in accordance with a further preferred embodiment of the invention.
Figure 4B:
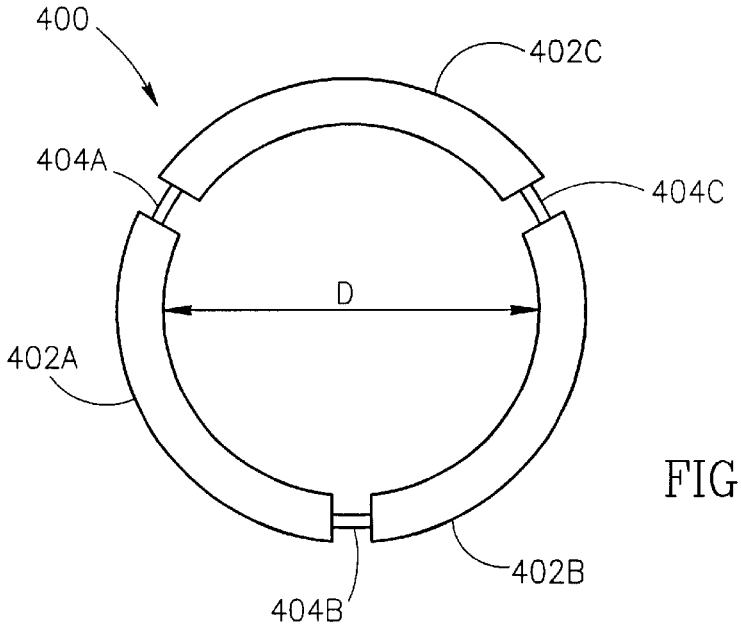
FIG. 4B is a rear view of the drag reducing device shown in FIG. 4A.

Reference is now made to FIGS. 4A and 4B. FIG. 4A is a schematic illustration of a moving object 490 and drag reducing device, generally designated 400, constructed and operative in accordance with a further preferred embodiment of the invention.

FIG. 4B is a rear view of drag reducing device 400. Device 400 includes a plurality of partial winglets, generally referenced 402A, 402B and 402C. Partial winglet 402A is connected to partial winglet 402B via connecting unit 404B. Partial winglet 402A is connected to partial winglet 402C via connecting unit 404A. Partial winglet 402C is connected to partial winglet 402B via connecting unit 404C. Each of the connecting units 404A 404B and 404C, is adapted to change the distance between the two winglets connected thereto, by means of conventional electromechanical servo units. Thus, according to the present embodiment, the general diameter D of device 400 can change and thus be adapted, in real time, to a plurality of factors such as the varying velocity of object 490, the fluid density, and the like.

For example, Applicant has found that a chord length c which equals 0.1 R, wherein R is the base radius, is less efficient in reducing the total drag than a chord length c which equals 0.3 R. Furthermore, a distance d of the device from base which equals 0.1 R is less efficient than, a distance d of the device from base which equals 0.05 R.

According to the present embodiment, device 400 is connected to a controller 412 which is operated by a processing unit 410. Processing unit 410 receives data representing different aspects of the movement of the object. The processor 410 utilizes this data for calculating the appropriate condition of each partial winglet 402 and provides controller 412 with instructions accordingly. The controller 412 operates the connecting units 404A, 404B, and 404C and instructs them to change the distance between each pair of adjacent partial winglets.

Figure 5B:
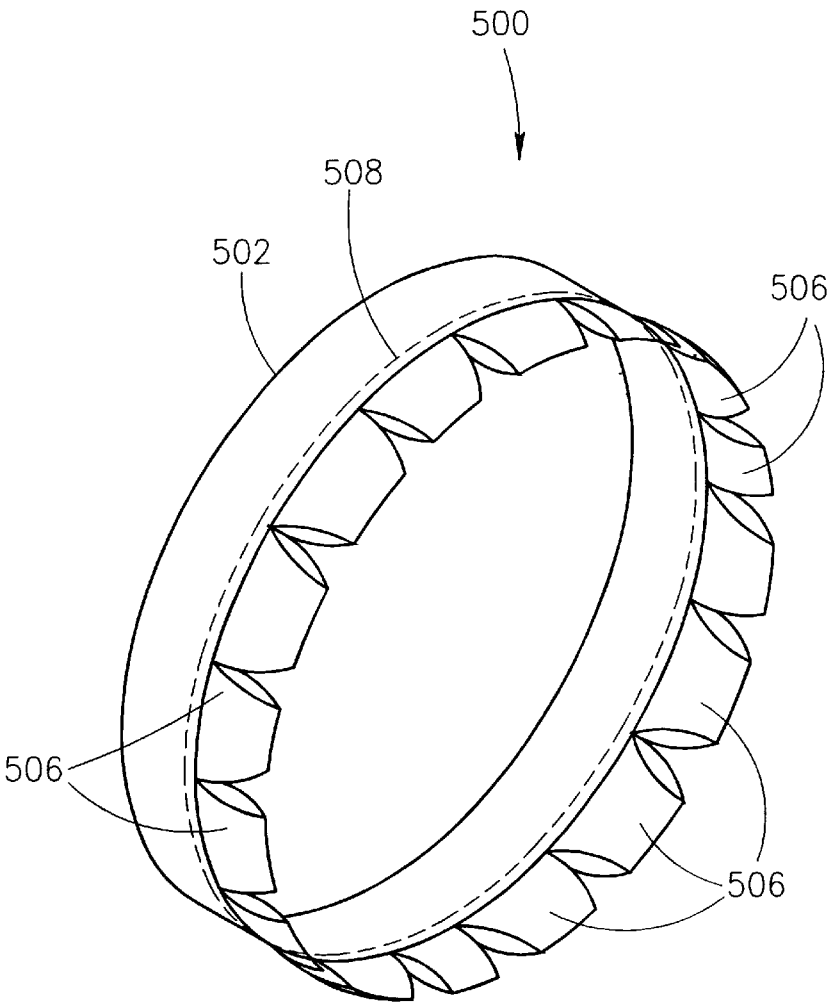
FIG. 5B is a pictorial illustration of the device shown in FIG. 5A, in an open state.
Figure 5A:
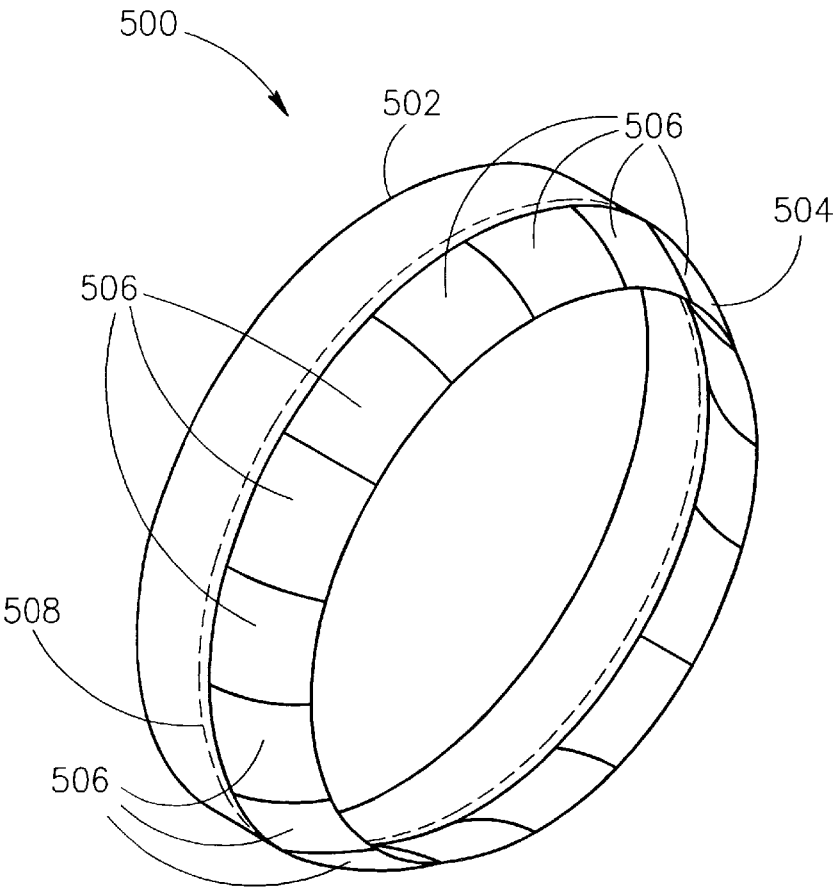
FIG. 5A is a pictorial illustration of a drag reducing device, constructed and operative in accordance with yet another preferred embodiment of the invention, in a closed state.

Reference is now made to FIGS. 5A and 5B. FIG. 5A is a schematic illustration of a drag reducing device, generally designated 500, constructed and operative in accordance with yet another preferred embodiment of the invention, in a closed state.

FIG. 5B is a pictorial illustration of device 500 in an open state.

Device 500 is a ring shaped winglet which includes a main winglet 502 and a secondary winglet 504. Secondary winglet 504 includes a plurality of partial winglets 506, which are connected to the main winglet 502 by hinges 508. The hinges 508 enable axial movement of each of the partial winglets 506. Each of the partial winglets provides self movement and may be controlled separately. Thus the secondary winglet 504 can transform from a closed state, shown in FIG. 5A to an open state, shown in FIG. 5B. This feature of the invention is merely an example of a winglet according to the invention, capable of dynamic shape changes.

Figure 6:
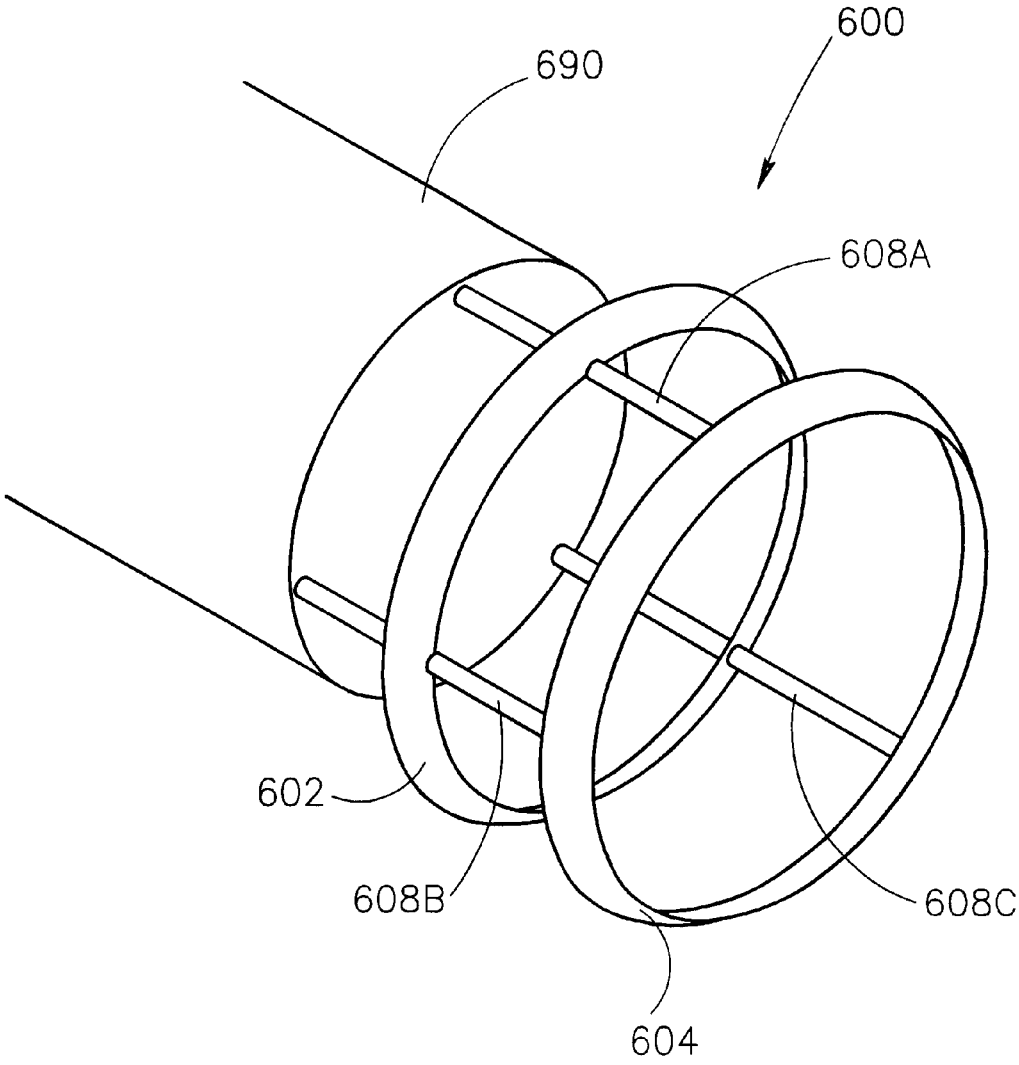
FIG. 6 is a schematic illustration of a moving object and a drag reducing device, constructed and operative in accordance with a further preferred embodiment of the invention.

Reference is now made to FIG. 6 which is a schematic illustration of moving object 690 and a drag reducing device, generally designated 600, constructed and operative in accordance with a preferred embodiment of the invention. Device 600 includes two winglet rings 602 and 604 which are placed near the rear of object. Winglets 602 and 604 are mounted on a plurality of bars, generally referenced 608A, 608B, and 608C. Bars 608A 608B and 608C extend from the base of object 690. Winglet 604 adds to the drag reduction which is initially provided by winglet 602. According to the invention, winglet 604 can be identical to winglet 602 or be different in one or more aspects such as profile, angle, height, and the like.

It will be appreciated by persons skilled in the art that the present invention is not limited to what has been particularly shown and described hereinabove. Rather the scope of the present invention is defined only by the claims which follow.

What is claimed is:

1. A device for reducing base drag in a truncated cylindrical projectile having a base radius R and moving in a fluid, said device comprising:

a ringlet shaped body having a first end and a second end, said body formed of at least one substantially continuous winglet, said substantially continuous winglet having an outer surface and an inner surface, said outer surface and said inner surface being cooperatingly configured for redistributing lateral vorticity and said inner surface extending along a taper such that said inner surface joins said outer surface at said respective first and second ends, such that said first end has a diameter greater than the diameter of said second end; and a mounting means connecting said ringlet shaped body near to the base of the projectile such that the first end of said ringlet shaped body is positioned approximately 0.05 R from said base of said projectile so that at least a portion of the ringlet is within a vortex ring caused by the projectile.

2. A device according to claim 1 wherein a selected one of said at least a substantially continuous winglet comprises a plurality of partial winglets and winglet connectors, each said winglet connector connecting a predetermined pair of said partial winglets.

3. A device according to claim 2 wherein each said winglet connector, is adapted to move said predetermined pair of said partial winglets connected thereto closer together and further apart.

4. A device according to claim 1 comprising a plurality of partial winglets and a plurality of hinges, said at least a substantially continuous winglet including a circumference along which are deployed said hinges and wherein said partial winglets are connected to said at least a substantially continuous winglet by said hinges, said hinges rotating said partial winglets along an axis tangent to the circumference defined by said hinges.

5. A device according to claim 1 further comprising:

a controller for controlling said at least a substantially continuous winglet according to predetermined parameters; and a processor, for determining the values of each of said parameters, according to the speed of said cylindrical projectile and the properties of said fluid, said processor providing said values to said controller.

6. A device according to claim 5 wherein said parameters are selected from the group consisting of:

distance from said cylindrical projectile;

winglet circumference;

the angle between the winglet chord and the symmetry axis of said cylindrical projectile;

a winglet profile; and a winglet chord length.

* * * * *